US006292948B1

(12) United States Patent
Chen

(10) Patent No.: US 6,292,948 B1
(45) Date of Patent: Sep. 25, 2001

(54) BATH GLOVE

(76) Inventor: Kuo-Chin Chen, 2-1 Fl., No.18, Alley 47, Lane 208, Jui An Street, Ta An District, Taipei (TW)

( * ) Notice: Subject to any disclaimer, the term of this patent is extended or adjusted under 35 U.S.C. 154(b) by 82 days.

(21) Appl. No.: 09/586,261

(22) Filed: May 31, 2000

(51) Int. Cl.[7] ..... A47K 7/02; A41D 25/00
(52) U.S. Cl. ..... 2/158; 2/159; 15/227
(58) Field of Search ..... 2/158, 159, 161.6, 2/167, 169; 15/227

(56) References Cited

U.S. PATENT DOCUMENTS

| | | | | |
|---|---|---|---|---|
| 1,941,320 | * | 12/1933 | Pamplin | 15/227 |
| 3,711,889 | * | 1/1973 | Jennings | 15/227 |
| 4,670,930 | * | 6/1987 | Lu | 15/118 |
| 4,825,499 | * | 5/1989 | Baptiste | 15/227 |
| 4,932,095 | * | 6/1990 | Kawase | 15/227 |
| 4,953,250 | * | 9/1990 | Brown | 15/104.94 |
| 4,969,225 | * | 11/1990 | Schubert | 15/229.12 |
| 4,980,943 | * | 1/1991 | Barber | 15/227 |
| 5,916,408 | * | 6/1999 | Chen | 15/227 X |

* cited by examiner

*Primary Examiner*—Gloria M. Hale
(74) *Attorney, Agent, or Firm*—Pro-Techtor International Services

(57) ABSTRACT

A bath glove is formed by weaving or knitting different yarns in a specific manner, so that a plurality of terry piles are evenly distributed over and rising from a surface of the bath glove by three different heights. The terry piles having the smallest height are tightened at their roots to each horizontally extend across and bind together the roots of two terry piles separately having the medium and the largest heights. The rising terry piles having the medium and the largest heights loosely overlap one another to give the bath glove a supple and elastic surface. The yarns for forming the terry piles having the medium height each is formed by sequentially twisting or tangling multiple nylon filaments together, and the yarns for forming the terry piles having the largest height each is formed by winding at least one surface filament around at least one core filament. The terry piles of different heights are soft to the touch and can catch more and finer foams among them for the bath love to effectively clean and massage a user's skin at he same time.

5 Claims, 5 Drawing Sheets

BATH GLOVE

BACKGROUND OF THE INVENTION

The present invention relates to a bath glove, and more particularly to a bath glove that is woven or knitted from yarns in a specific manner to have extraordinarily soft, supple and elastic to the touch and be capable of catching more and finer foams in cleansing a user's skin.

There are various types of commercially available body cleansing aids, such as bath towels, back brush, etc., for cleaning users' skins. Among these cleansing aids, there is a type of bath glove. A user may put on the bath glove when taking a bath or shower to conveniently brush and thereby clean the skin with the bath glove.

FIG. 1 illustrates a conventional bath glove and FIG. 2 is a locally enlarged top view of the bath glove of FIG. 1 to show a surface texture thereof. As can be clearly seen from FIG. 2, the conventional bath glove of FIG. 1 is formed simply by weaving or knitting man-made fibers 1 into a pattern in which a plurality of lines of regularly arranged meshes 2 are defined. The man-made fibers 1 and the meshes 2 together form an uneven surface of the bath glove woven or knitted from the man-made fibers 1. With this uneven surface, the bath glove is used to brush the user's skin in an attempt to clean the skin. The following are some disadvantages of the above-described conventional bath glove:

1. The uneven surface formed by the woven or knitted man-made fibers 1 and the meshes 2 gives the bath glove a very coarse texture that tends to scratch and hurt the user's skin.
2. The meshes 2 formed in the woven or knitted pattern as shown in FIG. 2 are large in size and therefore not able to effectively catch bubbles or foams produced from body cleansing foam or soap. The user needs to constantly add more body cleansing foam or soap onto the bath glove to complete the cleansing.
3. Since the bath glove fails to effectively catch foams or bubbles produced by the body cleansing foam or soap, it has not good cleansing effect.

In view of the above disadvantages existing in the conventional bath glove, it is tried by the inventor to develop an improved bath glove having soft surface texture that would not harm the user's skin and could effectively catch more and finer foams to thoroughly clean the user's skin with reduced amount of body cleansing foam or soap.

SUMMARY OF THE INVENTION

A primary object of the present invention is to provide a bath glove having a plurality of loosely overlapped terry piles formed on a surface thereof, such that the bath glove is particularly soft, supple and elastic to the touch without the risk of scratching and hurting the user's skin.

Another object of the present invention is to provide a bath glove having a plurality of loosely overlapped terry piles formed on a surface thereof, such that the bath glove is particularly effective in holding the cleansing foam or soap and catching more and finer bubbles among the terry piles for the bath glove to thoroughly clean the user's skin with reduced amount of body cleansing foam and soap.

A further object of the present invention is to provide a bath glove having a plurality of loosely overlapped terry piles formed on a surface thereof, such that the bath glove can gently massage the user's skin while cleaning the same.

To achieve the above and other objects, the bath glove of the present invention is formed by weaving or knitting yarns in a specific manner. The yarns for weaving or knitted into the bath glove are formed by twisting or stranding multiple man-made fibers into yarns. In weaving or knitting these yarns to form the bath glove, the yarns are separately hooked or otherwise pulled to form terry piles rising by different heights. Depending on the relative heights of the terry piles from a surface of the bath glove, the yarns forming these terry piles are referred to as bottom yarns, middle yarns, and top yarns. The terry piles formed from the bottom yarns are tightened at their roots to each substantially horizontally extends across and bind together the roots of two terry piles separately formed by a middle and a top yarn. The rising terry piles formed from the middle and the top yarns are different in height and loosely overlap one another and are therefore supple and elastic to the touch.

The middle yarn each is formed by sequentially twisting or tangling multiple nylon filaments together, and the top yarn each is formed by winding at least one surface filament around at least one core filament, so that the middle and the top yarns are structurally soft and supple to provide good elasticity.

The differently sized and loosely overlapped terry piles formed from the middle and the top yarns are evenly distributed over the entire surface of the bath glove to produce a plurality of small spaces among them. These small spaces effectively hold the body cleansing foam or soap and to catch a large number of fine foams or bubbles produced from the cleansing foam or soap to effect thorough cleaning of the user's skin.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
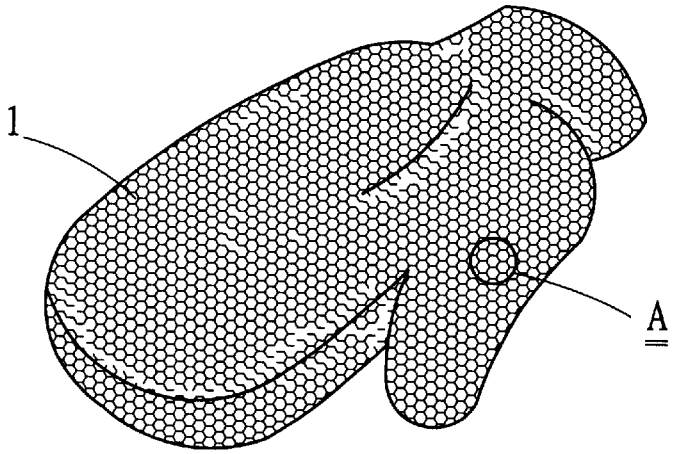
(PRIOR ART) FIG. 1
FIG. 1 is a perspective of a conventional bath glove.
Figure 2:
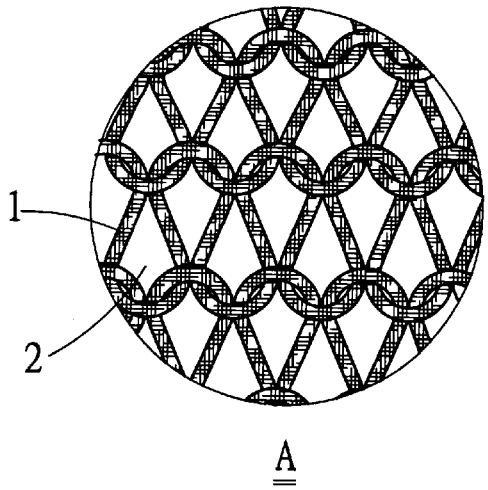
(PRIOR ART) FIG. 2
FIG. 2 is an enlarged view taken on an area indicated by circle A in FIG. 1.
Figure 3:
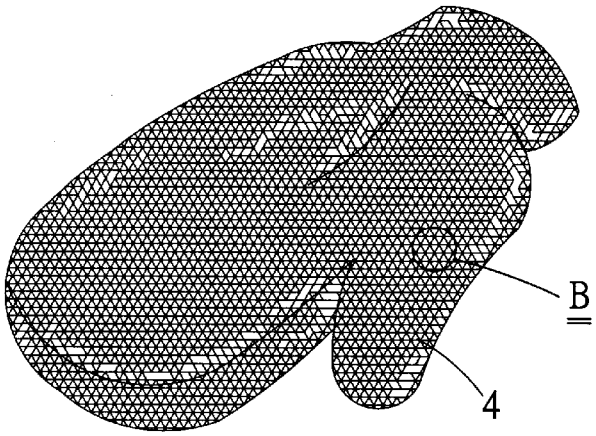
FIG. 3 is a perspective of a bath glove according to the present invention.
Figure 4:
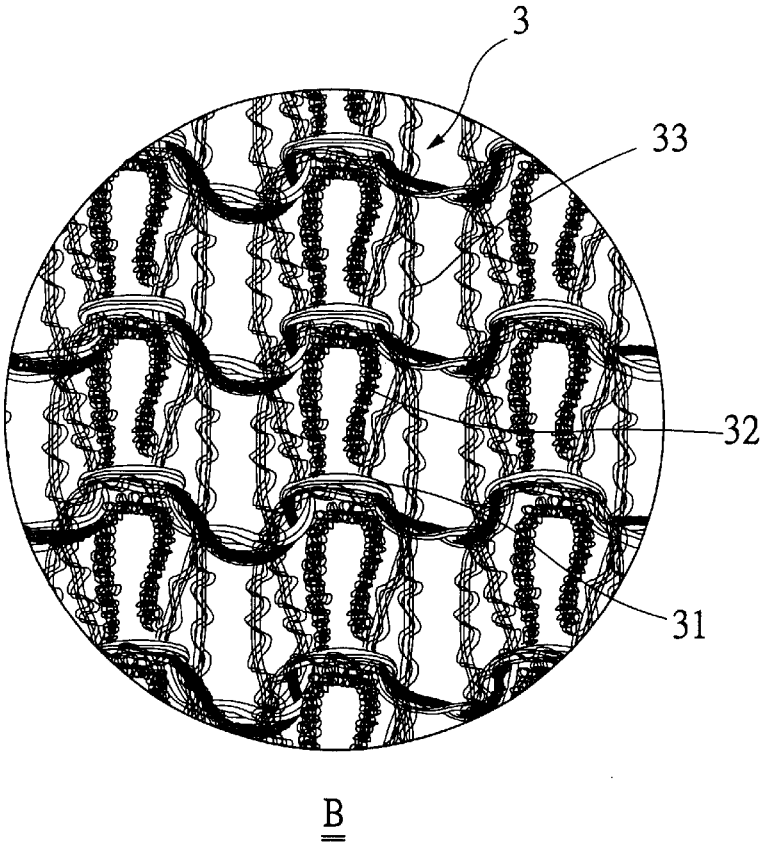
FIG. 4 is an enlarged top view taken on an area indicated by circle B in FIG. 3.
Figure 5:
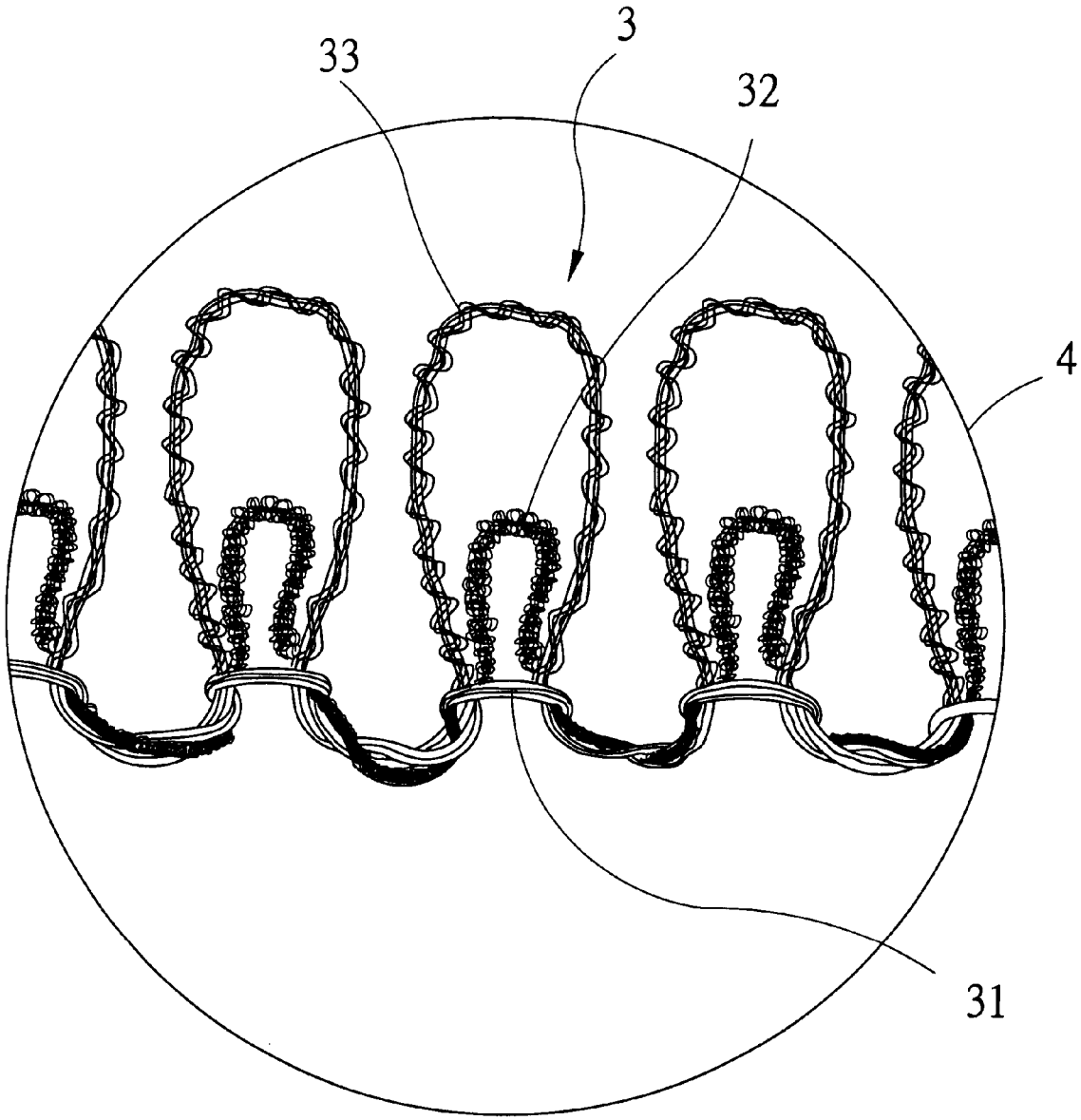
FIG. 5 is an enlarged side view of the area indicated by circle B in FIG. 3.

Please refer to FIGS. 3, 4 and 5 that are sequentially a perspective view, a locally enlarged top view, and a locally enlarged side view of a bath glove according to the present invention. The bath glove of the present invention is differently woven or knitted from yarns 3 that are formed by either winding, twisting or tangling multiple man-made fibers together. In weaving or knitting the yarns 3 into the bath glove, the yarns 3 are separately hooked or otherwise pulled to form terry piles rising by different heights. Depending on relative heights of the terry piles from a surface 4 of the bath glove, the yarns 3 forming these terry piles are referred to as bottom yarns 31, middle yarns 32, and top yarns 33. The middle yarns 32 are nylon yarns. The terry piles formed from the bottom yarns 31 are tightened at their roots so as to each extends across and bind together the roots of two terry piles separately formed from a middle and a top yarn 32, 33, so that the rising terry piles formed from the middle and the top yarns 32, 33 are soft to the touch. Moreover, each terry pile of the top yarn 33 actually extends over a terry pile of the middle yarn 32 to generally enclose the middle yarn terry pile in the top yarn terry pile. The difference in height between the terry piles of the middle and the top yarns 32, 33 makes the surface 4 of the bath glove softer, suppler and hairy to the touch.

Figure 6A:
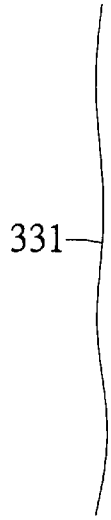
FIGS. 6A, 6B, and 6C illustrate the manner of winding filaments to form the top yarn adopted to weave the bath glove of the present invention.
Figure 6B:
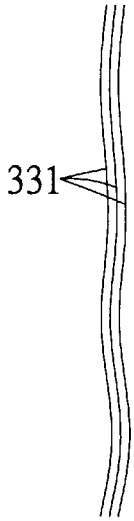
Figure 6C:
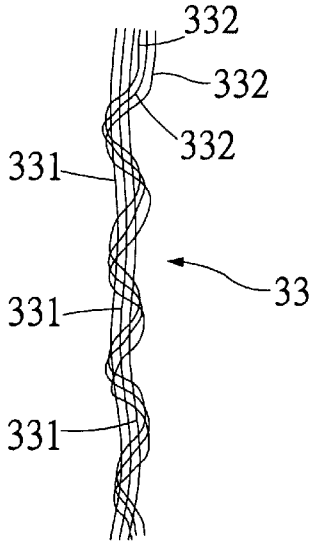

FIGS. 6A, 6B and 6C illustrate the manner of forming an individual top yarn 33. The top yarn 33 includes one or more core filaments 331 around which one or more surface filaments 332 wind. A top yarn 33 formed in this way has increased softness, suppleness and elasticity, and is able to catch more and finer foams among the filaments 331, 332.

Figure 7A:
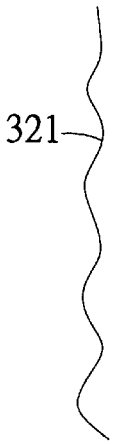
FIGS. 7A, 7B, and 7C illustrate the manner of twisting filaments to form the middle yarn adopted to weave the bath glove of the present invention.
Figure 7B:
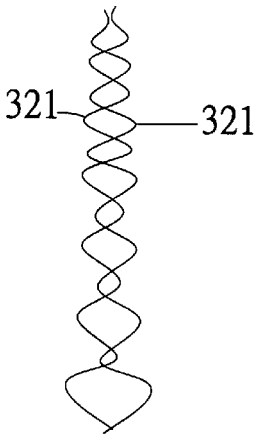
Figure 7C:
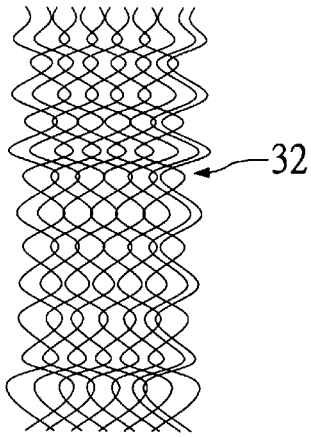

FIGS. 7A, 7B and 7C illustrate the manner of forming an individual middle yarn 32. The middle yarn 32 includes multiple nylon filaments 321 being sequentially loosely twisted or tangled together to form a yarn having loose and supple body and good elasticity, and is able to catch more and finer foams among the nylon filaments 321. In a preferred embodiment of the middle yarn 32, there are 15 nylon filaments included in one middle yarn 32.

Figure 8:
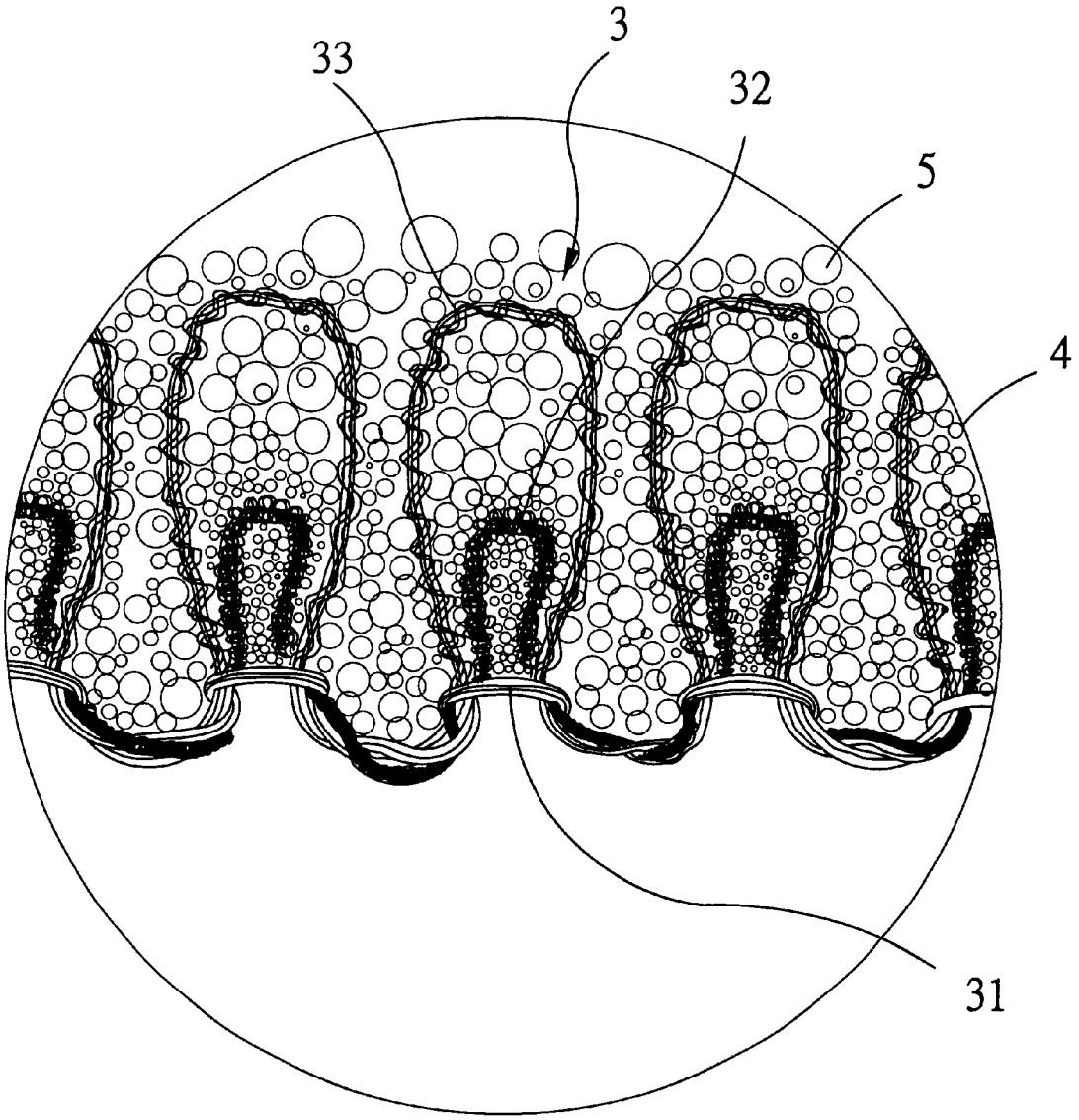
FIG. 8 is a locally enlarged side view of the bath glove of the present invention in use, showing that differently sized foams are produced and caught by terry piles formed by the middle and the top yarns on the bath glove.

FIG. 8 is a locally enlarged side view of the surface 4 of the bath glove of the present invention with a plurality of differently sized foams caught among the bottom, the middle and the top yarns 31, 32, and 33. As can be clearly seen from FIG. 8, the top and the middle yarns 32, 33 together form a plurality of overlapped terry piles. It is these overlapped terry piles that give the surface 4 the unique softness, elasticity and suppleness. As mentioned above, both the middle and the top yarns 32, 33 are formed from multiple mutually loosely wound or twisted filaments to provide a plurality of very small spaces among these loose filaments. These small spaces effectively catch more and finer foams among them for the bath glove to easily achieve its intended function of thoroughly cleaning a user's skin with reduced amount of body cleansing foam or soap. The supple and loosely overlapped terry piles of the middle and the top yarns 32, 33 also gently massage the user's skin while cleaning the skin and therefore protect the skin from being overly stimulated or being undesirably scratched and hurt.

The forming of the middle yarns 32 from multiple loosely twisted or tangled nylon filaments 321 gives the yarns 32 extraordinarily good elasticity and lasting softness that are useful in massaging the user's skin. Moreover, the nylon filaments 321 have particular gloss that makes the surface 4 of the bath glove visually attractive.

The following are some advantages of the bath glove of the present invention:

1. Both the middle and the top yarns 32, 33 are individually formed from multiple filaments and they are separately woven or knitted into terry piles of different heights relative to the bottom yarn 31, giving the surface 4 of the resultant bath glove a natural velvet touch and fleece-like softness and elasticity. These features allow the surface 4 of the bath glove to catch more and finer foams among the yarns 31, 32, and 33, enabling the bath glove to thoroughly clean the user's skin with reduced amount of body cleansing foam or soap.
2. The terry piles formed from the middle and the top yarns 32, 33 loosely overlap one another to provide the surface 4 of the bath glove with extraordinary softness and elasticity. The loosely overlapped terry piles gently massage the user's skin while cleansing the skin.
3. The loosely overlapped terry piles of the middle and the top yarns 32, 33 are soft and supple without the risk of scratching and hurting the user's skin.
4. The middle yarns 32 are formed from multiple loosely twisted or tangled nylon filaments 321 that provide even better elasticity than other types of yarns to enable the surface 4 of the bath glove to maintain in the soft and velvet state for a prolonged time and to more effectively massage the user's skin. The nylon filaments 321 have special gloss and therefore make the surface 4 of the bath glove visually attractive.

It is apparent that the present invention is illustrated with the description of a preferred embodiment thereof, and it is contemplated that many changes and modifications in the described embodiment can be carried out without departing from the scope of the invention which is intended to be limited only by the appended claims.

What is claimed is:

1. A bath glove comprising:

a plurality of terry piles evenly distributed on a surface of said bath glove, said terry piles comprise sections of three different lengths, a first length, a second length, and a third length;

first yarns forming said terry pile of said first length are tightened at roots of said first yarns during assembly so that each one of said first yarns crosses and binds together a root of one of a plurality of second yarns forming said terry pile of said second length and a root of one of a plurality of third yarns forming said terry pile of said third length, such that said terry pile of said second length and said terry pile of said third length rise from said surface of said bath glove; and wherein said second yarns of said second length comprise multiple nylon filaments, and said third yarns of said third length comprise at least one core filament and at least one surface filament wound around said at least one core filament.

2. The bath glove as claimed in claim 1, wherein:

said third yarns of said third length comprise only one said core filament and more than one said surface filament.

3. The bath glove as claimed in claim 1, wherein:

said third yarns of said third length comprise more than one said core filament and only one said surface filament.

4. The bath glove as claimed in claim 1, wherein:

said third yarns of said third length comprise more than one said core filament and more than one said surface filament.

5. The bath glove as claimed in claim 1, wherein:

said second yarns of said second length each comprise fifteen said nylon filaments.

* * * * *